United States Patent [19]

Kakui et al.

[11] 4,094,618

[45] June 13, 1978

[54] ROTARY PISTON ENGINES

[75] Inventors: Kuniaki Kakui, Hiroshima; Toshihiko Shigeta; Koso Koike, both of Kure, all of Japan

[73] Assignee: Toyo Kogyo Co., Ltd., Japan

[21] Appl. No.: 782,905

[22] Filed: Mar. 30, 1977

[30] Foreign Application Priority Data

Mar. 31, 1976 Japan ..... 51-36385

[51] Int. Cl.[2] ..... F01C 21/00

[52] U.S. Cl. ..... 418/178; 418/179

[58] Field of Search ..... 418/178, 179; 417/DIG. 1; 123/193 C; 75/123 CB; 428/667

[56] References Cited

U.S. PATENT DOCUMENTS

| | | | |
|---|---|---|---|
| 3,299,482 | 1/1967 | Tache et al. | 75/123 CB |
| 3,658,451 | 4/1972 | Gomada | 418/178 |
| 3,712,767 | 1/1973 | Beutter | 418/178 X |
| 3,830,601 | 8/1974 | Yamazaki | 418/178 X |
| 3,890,070 | 6/1975 | Sasame et al. | 418/178 |

*Primary Examiner*—Carlton R. Croyle
*Assistant Examiner*—Leonard Smith
*Attorney, Agent, or Firm*—Fleit & Jacobson

[57] ABSTRACT

Rotor housing for rotary piston engines having a base and a chromium-plated inner wall. The base is made of an iron-based material having a hardness of not less than 105 in Vickers' scale and the chromium-plated layer has a hardness not less than 850 in Vickers' scale. The rotor housing is used with a rotor having apex seals of iron-based material which includes 50 to 75% in volume of carbide at least in a sliding surface which is adapted to be brought into sliding engagement with the inner wall of the rotor housing, said apex seal having a hardness of 700 to 900 in Vickers' scale at the sliding surface.

6 Claims, 2 Drawing Figures

ROTARY PISTON ENGINES

Figure 1:
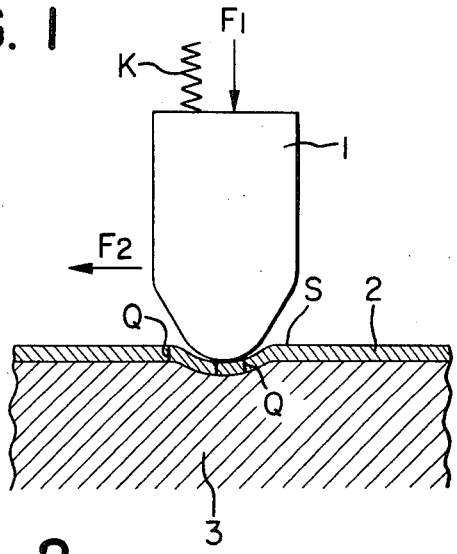

The present invention relates to rotary piston engines and more particularly to rotor housings having chromium-plated inner walls.

Conventional rotary piston engines generally comprise a casing which is constituted by a rotor housing having a trochoidal inner wall and a pair of side housings secured to the opposite sides of the rotor housing to define a rotor cavity therein. A rotor of substantially polygonal configuration is disposed in the cavity for rotation with its apex portions in sliding engagement with the inner wall of the rotor housing.

In order to provide the rotor housing with a wear resistant property, it has been a common practice to form a chromiumplated layer on the inner wall thereof. It has also been a common practice to provide an apex seal of a hard material such as a metal or ceramic in each apex portion of the rotor.

It has been experienced in such known arrangement that the chromium-plated inner wall of the rotor housing is subjected to various kinds of loads as the apex seal slides under pressure at high speed along the inner wall of the rotor housing. As the results, there are often produced in the chromium-plated surface abnormal wears such as those called as "chattered marks". Further, the base metal of the rotor housing has been subjected to a fatigue due to the cycle load which is imposed thereon from the apex seals of the rotor. Such fatigue of the base metal of the rotor housing has often caused a breakage of the base metal and the plated layer.

In old type rotary piston engines, the rotor housing has been provided by an aluminum alloy, however, in view of the above disadvantage, there is an increasing tendency that an iron-based material is used for the purpose. Such iron-based material is used usually in the form of a sheet metal or any other convenient form. Experiences have shown that the employment of the iron-based material in the rotor housing is not a completely satisfactory measure for eliminating the above problems.

It is therefore an object of the present invention to provide a rotor housing which is free from the problems in the conventional construction.

Another object of the present invention is to provide a rotor housing for rotary piston engines having a chromium-plated inner wall which is of increased durability as compared with that in conventional engines.

A further object of the present invention is to provide a rotor housing having a chromium-plated inner wall in which the hardness of the chromium-plated layer and that of the base metal are so determined that the frequency of the self-excited vibration of the co-operating apex seal becomes out of a predetermined range.

According to the present invention, the above and other objects can be accomplished by a rotary piston engine comprising a casing which includes a rotor housing having a trochoidal inner wall and a pair of side housings secured to the opposite sides of the rotor housing to define a cavity therein, and a substantially polygonal rotor disposed in said cavity for rotation with apex portions in sliding engagement with the inner wall of the rotor housing, said rotor being provided at each apex portion with an apex seal of iron-based material which includes 50 to 75% in volume of carbide at least in a sliding surface which is adapted to be brought into sliding engagement with the inner wall of the rotor housing, said apex seal having a hardness of 700 to 900 in Vicker's scale at the sliding surface, said rotor housing including a base which is made of an iron-based material having a hardness of not less than 105 in Vickers' scale and provided at its inner wall with a chromium-plated layer having a hardness not less than 850 in Vickers' scale, the hardness of the rotor housing base and that of the chromium-plated layer being in a region defined in a chart having an ordinate representing the hardness of the rotor housing base and an abscissa representing the hardness of the chromium-plated layer by a line connecting a first point which corresponds to the base hardness of 180 and the plated layer hardness of 850 and a second point which corresponds to the base hardness of 125 and the plated layer hardness of 950, and also by a further line connecting said second point and a third point which corresponds to the base hardness of 105 and the chromium plated layer hardness of 1200, all in Vicker's scale, said region being at a side of the lines wherein the values of the hardness are greater than those on the lines.

Figure 2:
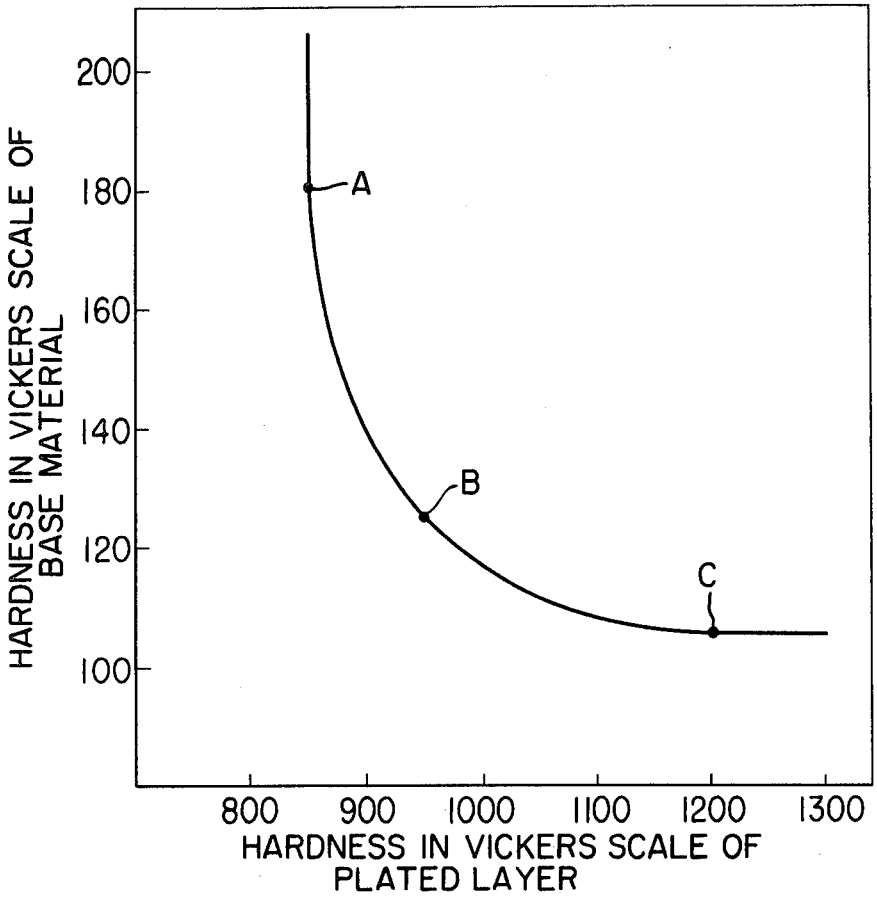

In order that the invention is more clearly understood, descriptions will further be made taking reference to the accompanying drawings, in which:

FIG. 1 is a fragmentary sectional view showing the inner wall of the rotor housing and the apex seal; and FIG. 2 is a diagram showing the relationship between the hardness of the base material of the rotor housing and that of the chromium plating.

The causes of chatter marks have not been theoretically clarified yet but the inventors have found that the factors affecting on the chatter marks include the force under which the apex seal is maintained in contact with the plated inner wall of the rotor housing, the frequency of the self-excited vibration of the apex seal, the surface irregularities of the chromium-plated layer and congeniality of the materials of the apex seal and the plated layer.

The self-excited vibration is also considered as a major cause of breakage of the chromium plated layer. In operation of rotary piston engines, the apex seal 1 is subjected to a normal force $F_1$ which is applied by a back-up spring K and generally normal to the inner wall of the rotor housing, as well as a tangential force $F_2$ which acts along the inner wall surface 2. Since the tangential force $F_2$ is variable and of a cyclic nature, a self-excited vibration is produced in the apex seal. Where the frequency of the exciting force is close to the natural frequency of the apex seal 1, the amplitude of the self-excited vibration is increased so that the plated layer on the inner wall of the rotor housing is subjected to a cyclic vibratory force in addition to the force which is a resultant of the normal and the tangential forces. Under the influences of these forces, the plated layer may be produced with cracks and eventually the plated layer may be cyclically depressed so that the load on the apex seal is transmitted to the base metal of the rotor housing without being absorbed by the plated layer. Thus, the base metal is subjected to a fatigue through a prolonged time of operation and broken together with the adjacent plated layer.

For the purpose of preventing the chatter marks and the breakage of the plated layer on the rotor housing, investigations have been made on the congeniality of the materials of the apex seal and the chromium plated layer on the rotor housing. As the result, it has been found that the apex seal should preferably include as much non-metallic components as possible in the sliding surface. Further, it should be of a wear resistant property and should have a hardness slightly lower than that of the plates layer on the rotor housing. In view of the above requirements as well as the congeniality with the chromium plating on the rotor housing, an iron-based material, particularly, a cast iron material is considered as being recommendable for the apex seal. Where the cast iron is employed, the apex seal may not necessarily be moulded but may be produced by sintering the cast iron material. A wear resistant cast iron material is preferable but a plain cast iron may also be employed.

In order to provide a high concentration of non-metallic material such as carbides at the sliding surface of the apex seal, a chilling process may conveniently be employed when the apex seal is to be produced through a moulding technique from a cast iron. Where a sintering process is employed, powders of carbon or carbides may be suitably added to the sliding surface. Preferably, the apex seal should contain 50 to 75% in volume of carbides at the sliding surface. With the carbide content less than 50% in volume, an increased area of metallic part is brought into contact with the chromium plating on the rotor housing resulting in an increase in chatter marks. With the carbide content greater than 75% in volume, there will be a difficulty in manufacture and decrease in the strength and the toughness. Further, the hardness of the apex seal at the sliding surface should be 700 to 900 in Vickers' scale and slightly lower than that of the chromium plating on the rotor housing. With the hardness lower than 700, the sliding surface cannot provide an adequate wear resistant property but, with the hardness exceeding 900, the hardness of the apex seal becomes so close to the hardness of the chromium plating that the room of selection of the chromium plating will be narrowed.

Thus, it is recommendable that the apex seal is basically made of an iron-based material with a sliding surface containing 50 to 75% in volume of carbides and having a hardness of 700 to 900 in Vickers' scale. However, a satisfactory result could not be obtained only through the proper selection of the material in the apex seal.

The inventors have therefore extended their investigations to determine how and to what extent the frequency of the self-excited vibration of the apex seal and the surface condition of the chromium plating on the rotor housing have influences on the creation of defects such as chatter marks and the brakage of the plated layer.

It is considered that the frequency of the self-exciting vibration of the apex seal is dependent on the normal force $F_1$ which acts on the apex seal 1 in the direction normal to the inner wall or the plated layer 2 on the rotor housing 3, the tangential force $F_2$, the natural frequency of the spring K and the surface irregularities S of the plated layer 2. Through the investigation, the inventors have found that there are increased changes of chatter marks and breakage being produced in the plated layer as long as the frequency of the self-excited vibration of the apex seal is 5 to 15 Kilocycles per second. Therefore, efforts have been made to have the frequency out of the above range.

The present invention is based on the finding that, among the factors affecting on the frequency of the self-excited vibration of the apex seal, the surface condition of the chromium plated layer 2 is controllable. Such surface condition of the plated layer includes existence of cracks and surface irregularities in the plating and is primarily dependent on the surface hardness. The surface hardness is determined not only by the hardness of the chromium plating itself but also by the hardness of the base material of the rotor housing since the plated layer is as thin as 50 to 250 microns and the hardness of the base material has an important influence on the surface hardness.

Thus, the inventors have made investigations on the relationship of the hardness of the chromium plating and the hardness of the base material with the chatter marks on the plated surface and the breakage of the plated layer. For the purpose, tests have been made on two-rotor type rotary piston engines having a displacement of 573 cc for each working chamber with the rated output of 120 ps. Various types of rotor housings have been prepared with the base materials having the hardness of 70 to 200 in Vickers' scale and the chromium plating having the hardness of 700 to 1200 in Vickers' scale. The apex seals were prepared by an acicular cast iron having a chilled structure on the surface.

The tests have been performed by repeated cycles of first maintaining the engine at 1500 rpm under an unloaded condition, then increasing the speed and the load of the engine in 15 seconds to the full load condition at 7000 rpm, maintaining the full load operation for 20 seconds and returning to the unloaded condition at 1500 rpm. The number of operating cycles has been counted until chatter marks or brekages of the plated layer are produced. FIG. 2 shows combinations of the hardness of the base material and that of the chromium plating with which such chatter marks or breakage of the plating are produced at about 15,000 cycles of the above operation.

In FIG. 2, it will be understood that chatter marks and breakages of the chromium plating on the rotor housing are influenced by the hardness of the chromium plating and that of the base material. In order to ensure that such defects are not produced before 15,000 cycles of the operation, which is considered as being equivalent to an actual running of 300,000 km under relatively heavy conditions, the hardness of the base material must not be smaller than 105 in Vickers' scale and the hardness of the chromium plating should not be smaller than 850 in Vickers' scale. It should further be noted that the hardness of the base material as well as that of the chromium plating must be in the region which is defined at the right upper side of a line passing through a first point A corresponding to the base material hardness of 180 and the chromium plating hardness of 850, a second point B corresponding to the base material hardness of 125 and the chromium plating hardness of 950, and a third point C corresponding to the base material hardness of 105 and the chromium plating hardness of 1200, all in Vickers' scale.

The present invention thus proposes, in a rotary piston engine including a rotor housing having a chromium plated inner wall, to provide apex seals by iron-based material including 50 to 75% in volume of carbides at least in the sliding surface and having a hardness of 700 to 900 in Vickers' scale and at the same time to determine the hardness of the chromium plating and that of the base material of the rotor housing in the above specified range.

With respect to the base material of the rotor housing, the above hardness requirement can be readily achieved by utilizing a sheet material of high tension steel. When the rotor housing is made of a cast iron, the above hardness requirement may be achieved through a heat treatment. Any suitable cast iron, steel or iron-based sintered metal may be employed as the base material.

The base material may be used as it is or may be heat treated in order to provide a required hardness. The base material may be in the form of a sheet metal which is attached to the inner surface of the body of rotor housing. Alternatively, the base material may be sprayed onto the inner surface of the rotor housing body. There is no upper limit in the hardness of the base material. For the purpose of preventing breakage of the plated layer, the hardness of the base material should be as high as possible but in view of the cost and the manufacturing technique the hardness should be less than 1000, practically less than 350 in Vickers' scale.

There is no upper limit in the hardness of the chromium plating. However, practically, it is preferred to maintain the hardness below 1200 in Vickers' scale because there will be an increased difficulty in manufacture where the hardness exceeds 1200. Further, an excessively hard plating will cause an increase in the wear of the apex seal.

It should be noted that although the invention has thus been shown and described it should in no way be limited to the details of the descriptions but changes and modifications may be made without departing from the scope of the appended claims.

We claim:

1. Rotary piston engine comprising a casing which includes a rotor housing having a trochoidal inner wall and a pair of side housings secured to the opposite sides of the rotor housing to define a cavity therein, and a substantially polygonal rotor disposed in said cavity for rotation with apex portions in sliding engagement with the inner wall of the rotor housing, said rotor being provided at each apex portion with an apex seal of iron-based material which includes 50 to 75% in volume of carbide at least in a sliding surface which is adapted to be brought into sliding engagement with the inner wall of the rotor housing, said apex seal having a hardness of 700 to 900 in Vickers' scale at the sliding surface, said rotor housing including a base which is made of an iron-based material having a hardness of not less than 105 in Vickers' scale and provided at its inner wall with a chromium-plated layer having a hardness not less than 850 in Vickers' scale, the hardness of the rotor housing base and that of the chromium-plated layer being in a region defined in a chart having an ordinate representing the hardness of the rotor housing base and an abscissa representing the hardness of the chromium-plated layer by a line connecting a first point which corresponds to the base hardness of 180 and the plated layer hardness of 850 and a second point which corresponds to the base hardness of 125 and the plated layer hardness of 950, and also by a further line connecting said second point and a third point which corresponds to the base hardness of 105 and the chromium plated layer hardness of 1200, all in Vickers' scale, said region being at a side of the lines wherein the values of the hardness are greater than those on the lines.

2. Rotary piston engine in accordance with claim 1 in which said base material of the rotor housing is a cast iron.

3. Rotary piston engine in accordance with claim 2 in which said base material of the rotor housing is heat treated at a surface on which said chromium plated layer is formed.

4. Rotary piston engine in accordance with claim 1 in which said base material is in the form of a sheet attached to a body of the rotor housing and said chromium-plated layer is formed on the sheet.

5. Rotary piston engine in accordance with claim 1 in which said base material of the rotor housing is formed by spraying a molten metal onto a body of the rotor housing.

6. Rotary piston engine in accordance with claim 1 in which said apex seal is made of an acicular cast iron having a chilled structure on the surface.

* * * * *